US005211159A

United States Patent [19]

Lieblein et al.

[11] Patent Number: 5,211,159

[45] Date of Patent: May 18, 1993

[54] EXHAUST HOOD WITH DISPOSABLE FILTER ASSEMBLY AND FILTER-CONDITION SENSOR

[75] Inventors: Leonard R. Lieblein, Williamston; Raymond W. Rogers, Mauldin; William F. Harnesberger, Pelzer, all of S.C.

[73] Assignee: Standex International Corporation, Salem, N.H.

[21] Appl. No.: 697,303

[22] Filed: May 6, 1991

Related U.S. Application Data

[63] Continuation-in-part of Ser. No. 516,255, Apr. 30, 1990, Pat. No. 5,154,161, which is a continuation-in-part of Ser. No. 280,025, Dec. 2, 1988, abandoned.

[51] Int. Cl.[5] ..... F24C 15/20

[52] U.S. Cl. ..... 126/299 R; 126/299 D; 454/49; 454/67

[58] Field of Search ..... 126/299 R, 299 C, 299 D; 98/115.1, 115.3; 454/49, 56, 60, 67

[56] References Cited

U.S. PATENT DOCUMENTS

| | | | |
|---|---|---|---|
| 3,518,814 | 7/1970 | Maynard | 98/115.1 X |
| 3,885,822 | 5/1975 | Cohen et al. | 415/1 X |
| 4,160,407 | 7/1979 | Duyn | 126/299 R X |
| 4,350,504 | 9/1982 | Diachuk | 126/299 C X |
| 4,460,332 | 7/1984 | Lawler et al. | 126/21 A X |
| 4,738,244 | 4/1988 | Welsh | 126/299 R |
| 4,982,605 | 1/1991 | Oram et al. | 98/115.3 X |
| 5,063,906 | 11/1991 | Rogers et al. | 126/299 R X |

*Primary Examiner*—Larry Jones

*Attorney, Agent, or Firm*—Dominik, Stein, Saccocio, Reese, Colitz & Van Der Wall

[57] ABSTRACT

The invention of this application comprises a novel filter assembly including a charcoal filter and a fiberglass filter positioned within a housing. The fiberglass filter comprises a fiberglass mat mounted to a wire structure formed in an accordion-shape so as to increase the surface area of the fiberglass mat. The invention also comprises a novel sensor system for sensing when the grease filter and the filter assembly have been installed, for sensing when the filter assembly is about to require changing and for shutting down the exhaust hood when the assembly requires changing.

11 Claims, 9 Drawing Sheets

130
60
BLOWER MOTOR
RECPT
X
Y
Z
G
138
FUSE
L1
L2
L3
134
ICR
136
FUSE
L2
L1
START
140
STOP
142
DOOR INTER-LOCK
144
FILTER CLOGGED VACUUM SWITCH
158
RT. SIDE COVER INTER-LOCK
146
FIRE EXTINGUISHER ARMED SWITCH
148
132
ICR
MAIN POWER CONTACTOR
150
CONTACTS FOR FIRE ALARM SIGNAL
CHANGE FILTER LIGHT
162
FILTER ASS'Y. VACUUM SWITCH
154
GREASE BAFFLE VACUUM SWITCH
152
160
ICR
FILTER DIRTY VACUUM SWITCH
156

EXHAUST HOOD WITH DISPOSABLE FILTER ASSEMBLY AND FILTER-CONDITION SENSOR

CROSS-REFERENCE TO RELATED APPLICATIONS

This application is a continuation-in-part application of U.S. patent application, Ser. No. 07/516,255 filed Apr. 30, 1990, which is continuation-in-part of U.S. patent application Ser. No. 07/280,025 filed Dec. 2, 1988, now abandoned, which is the parent application of U.S. patent application Ser. No. 07/597,111 filed Oct. 12, 1990, now U.S. Pat. No. 5,063,906, issued Nov. 12, 1991.

BACKGROUND OF THE INVENTION

1. Field of the Invention

This invention relates to exhaust hoods for food cookers. More particularly, this invention relates to exhaust hoods having a removable filter assembly for filtering the grease-laden vapors from a cooking apparatus such as a pressure cooker and for exhausting such vapors after filtering. This invention also relates to sensor means for determining when the filter assembly requires changing.

2. Description of the Background Art

Exhaust hoods have been widely used in connection with food cooking apparatus. In the case of cooking apparatus such as pressure fryers and the like, fixed exhaust hoods have been mounted in fixed position upon the cooking apparatus for .venting to the outside of the building. As an alternative to venting to the outside of the building, other hoods have been provided for positioning over a cooking apparatus, and have included a variety of filters including electrostatic filters, that sufficiently clean the grease-laden vapors so that they can be vented to the inside of the building. For example, U.S. Pat. No. 4,854,949 illustrates an exhaust hood having a filter assembly and having a fan positioned to draw vapors therethrough to vent to the inside of the room.

Other prior art is exemplified by U.S. Pat. Nos. 3,747,301, 4,143,646, 4,155,348, 4,489,647, 4,505,194, 4,520,717 and 4,539,898 which illustrate the use of a variety of filters as an integral part of cooking apparatus.

In many locations, such as convenience stores, there exists a need for a movable exhaust hood, for use with movable cooking apparatus, that filters the grease-laden vapors and then vents the cleaned vapors inside of the building. Importantly, the construction, type and arrangement of the filters determines the effectiveness of removing grease and other particulate matter from the grease-laden vapors flowing from the cooking apparatus. Furthermore, as the filters become saturated with grease and other particulate matter, their effectiveness are substantially decreased. However, early cleaning and changing of the filters is wasteful and uneconomical. Hence, there exists a need for being able to determine the ideal time for changing the filters.

Accordingly, it is an object of the invention to provide a support for carrying a hood above a cooking apparatus as well as a base for providing stability to the hood and filter carried thereby.

Another object of the invention is the provision of a free-standing exhaust hood with filters for use above a variety of cooking apparatus for cleaning the grease-laden vapors from the apparatus and venting the cleaned vapors within the building.

Another object of the invention is to provide a separate movable hood for use with a portable cooking apparatus such as a deep fat fryer.

Another object of the invention is to provide a hood for use with cooking apparatus for carrying fire extinguishing apparatus independently of the cooker.

Another object of the invention is the provision of a movable hood having a fan for creating vapors flow through a filter carried in the hood and returning filtered vapors to a building.

Another object of the invention is to provide a hood having filters that are accessibly positioned within the hood for easy removability.

Another object of this invention is to provide a hood having a filter assembly that is a more effective and simplified filter assembly with reduced parts.

Another object of this invention is to provide a hood having sensor means for sensing when the proper filter assembly is installed.

Another object of this invention is to provide a hood having sensor means for providing an advance warning of when the filter assembly requires changing.

Another object of this invention is to provide a hood having sensor means for sensing when the filter assembly requires changing and for then shutting-down the exhaust hood and the cooking apparatus.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a free-standing exhaust hood for use within a building. More particularly, this invention comprises an exhaust hood carried by a support structure and base which straddles the cooking apparatus such that the exhaust hood is positioned above the cooking apparatus. The exhaust hood contains filters and a fan for drawing grease-laden vapors from the cooking apparatus through the filters for cleaning. Preferably, the exhaust hood includes a grease filter for removing larger grease and moisture particles from the grease-laden vapors from the cooking apparatus. Also preferably, the exhaust hood includes a filter assembly which filters the finer particles from the vapors and deodorizes the vapors. The cleaned and deodorized vapors are then vented into the room of the building. Hence, venting to the outside of the building is unnecessary.

A fire extinguisher assembly is mounted at the rear of the base, separate from the cooking apparatus, so as to function as a counterbalance and minimize forward tipping the exhaust hood. The fire extinguisher assembly is preferably automatically discharged upon the occurrence of elevated temperatures. At least three discharge nozzles are provided, one positioned immediately above the cooking apparatus, one between the grease filter and the filter assembly and one above the filter assembly. In this manner, the fire extinguishing medium is directed against the cooking apparatus as well as against the filters within the hood.

In the parent application to this invention, the filter assembly preferably comprises a charcoal filter and an electrostatic ionizer precipitator positioned in vertically aligned stacked relation in a housing. The housing containing the charcoal filter and the precipitator is removably positioned within the exhaust hood above a grease filter.

The invention of this application comprises a novel filter assembly including a charcoal filter and a fiberglass filter positioned within a housing. The fiberglass filter comprises a fiberglass mat mounted to a wire structure formed in an accordion-shape so as to increase the surface area of the fiberglass mat exposed to the grease-laden vapors.

This invention also comprises a novel sensor system for sensing when the grease filter and the filter assembly have been installed, for sensing when the filter assembly is about to require changing, and for shutting-down the exhaust hood (and the cooking apparatus plugged into it) when the filter assembly requires changing. In this manner, the operator readily knows when a grease filter and/or a filter assembly is not installed or when a non-approved filter assembly is installed. Further, the operator is notified, in advance, when the filter assembly is becoming sufficiently contaminated that it will soon require changing. Finally, should the operator not heed the advance warning, the sensor assembly automatically shuts down the exhaust hood (and the cooking apparatus) so as to prevent grease-laden vapors from being exhausted into the room of the building.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
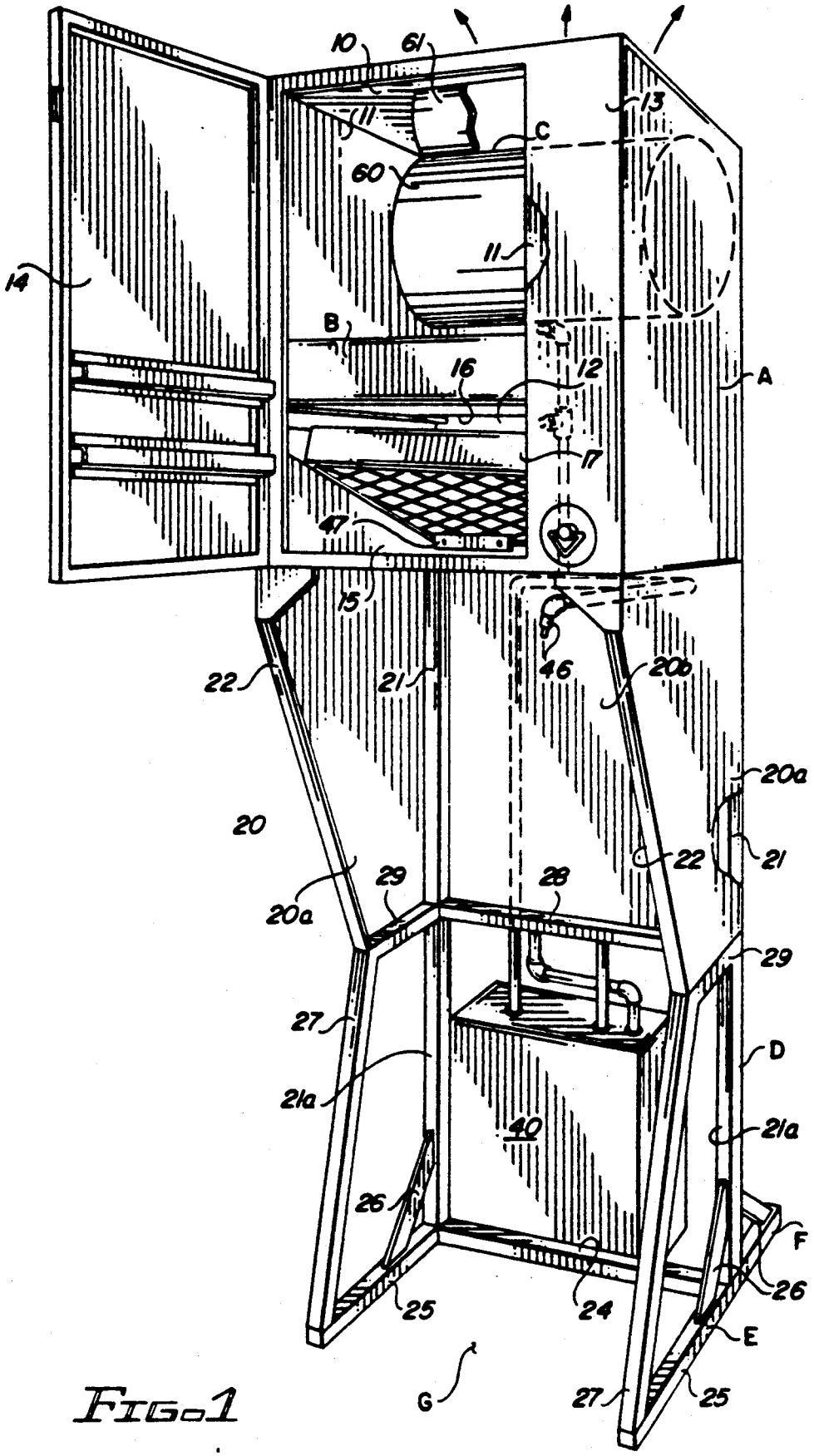
FIG. 1 is a perspective view of the first embodiment of the exhaust hood of the invention illustrating an air filter carried in a hood having a support and base structure for accommodating an independently movable cooking apparatus.

The drawings illustrate apparatus for filtering vapors from a food cooking apparatus utilized within a building. A hood A extends over a cooking apparatus for receiving heated vapors containing contaminants flowing upwardly therefrom during a cooking operation. A filter assembly B is positioned within the hood A removing contaminants from the heated vapors. The hood A has an opening C therein for returning heated vapor into the building after the contaminates have been removed. A support structure D is provided for carrying the hood A above the cooking apparatus straddling the cooking apparatus. A base E carries the support structure D and hood A for movement within the building. The base E includes a rearward extension F carrying and affording stability for the support structure D and the hood A independently of the cooking apparatus. A receiving area G is defined by the support structure D and the base E for accommodating the cooking apparatus for positioning beneath the hood A and affording access to the cooking apparatus during a cooking operation. Thus, a free-standing hood A is provided avoiding a necessity for fixed vents for cooking apparatus within a building.

The hood A is generally rectangular and includes a top 10, opposed sides 11 and a rear wall 12. An instrument panel is included in the compartment 13 formed on one side of the hood A. A hinged door 14 acts as a closure for the hood A which is open at the bottom as at 15.

The filter assembly B is illustrated in the form of a precipitator electrostatic ionizer and extends across the hood A above a suitable pre-filter element illustrated at 16. Beneath the pre-filter element 16 is a grease filter 17 that is inclined downwardly rearwardly. Such inclined grease filters are known generally in the trade as flame guard protectors and act to drain grease downwardly and to the rear. The grease collects from contaminated vapor including grease-laden vapors which may include steam and smoke ascending into the hood A from the cooker. Such contaminated air is circulated upwardly into the hood by a fan 60 and passed outwardly through an opening C in the top 10 of the hood A. The contaminated air flows upwardly from the grease filter 17, through the pre-filter 16 and into the precipitator electrostatic ionizer B.

The hood A is illustrated as including a downward extension broadly designated at 20 which includes downwardly tapering side panels 20*a* and back panel 20*b* which is a downward extension of the rear wall 12. The downward extension of the hood A includes structural sections which extend downwardly as at 21 from each of the rear corners of the hood A. Downwardly and inwardly inclined structural members 22 form an upper portion of the receiving area G for accommodating the food cooking device to be inserted beneath the hood A. The support structure D further includes a lower portion formed by extensions 21*a* of the structural members 21 and such are bridged at the lower end by the structural members 24 which join together with the longitudinally spaced aligned structural members 25 to make up the base E and its rearward extension F. Suitable braces 26 are provided to join the base members with the support structure D. The support structure D further includes forward members which extend downwardly and forwardly as at 27. These members 27, together with the members 22, form the frame for the receiving area G. The support structure D includes at mid-section thereof a rear horizontal support 28 as well as lower side supports 29. The upright structural members 21, 21*a*, 22, 27 and horizontal supports 28 and 29 form spaced standards which straddle the cooker and support the hood A.

Figure 3:
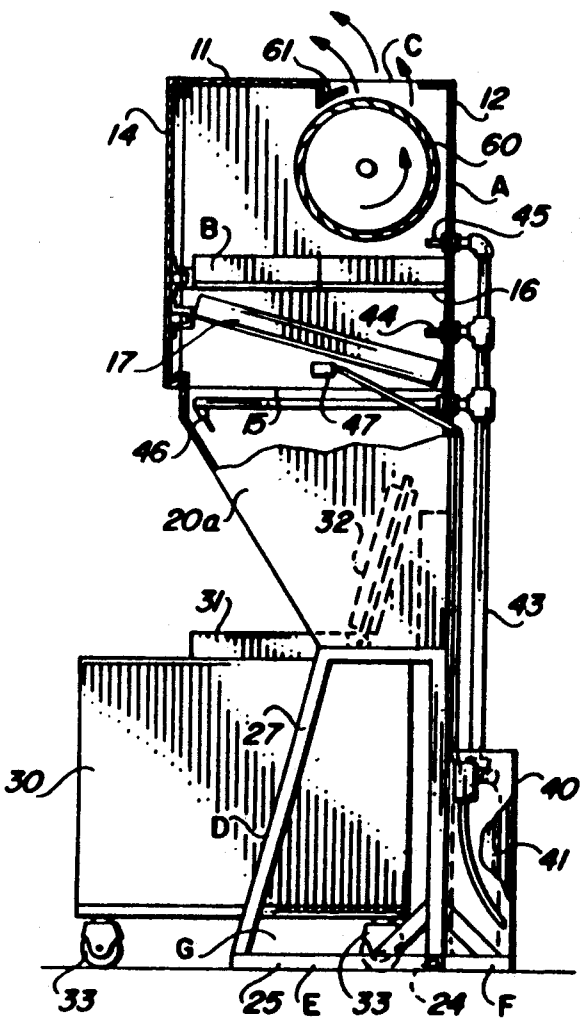
FIG. 3 is a side elevation of the apparatus of FIG. 1, with parts broken away, illustrating a cooking apparatus in the form of a deep fat pressure fryer positioned therein.
Figure 5:
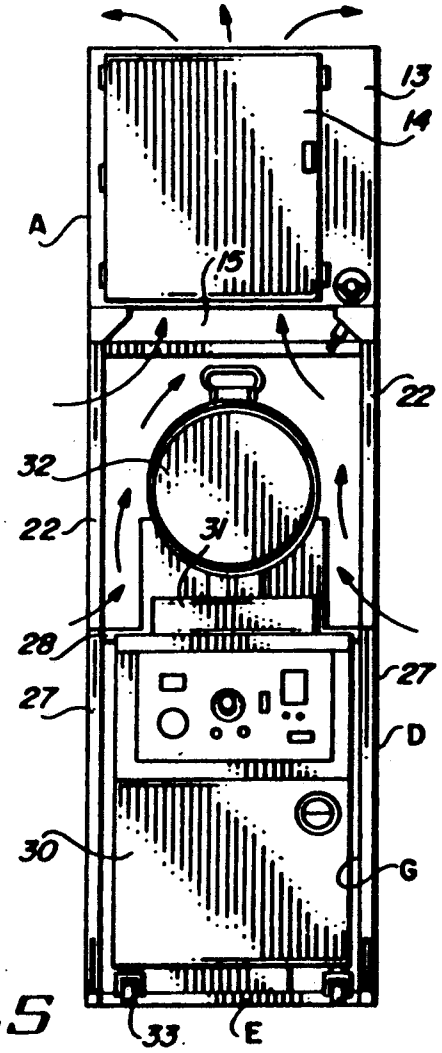
FIG. 5 is a front elevation further illustrating the apparatus with a cooking apparatus positioned therein.
Figure 4:
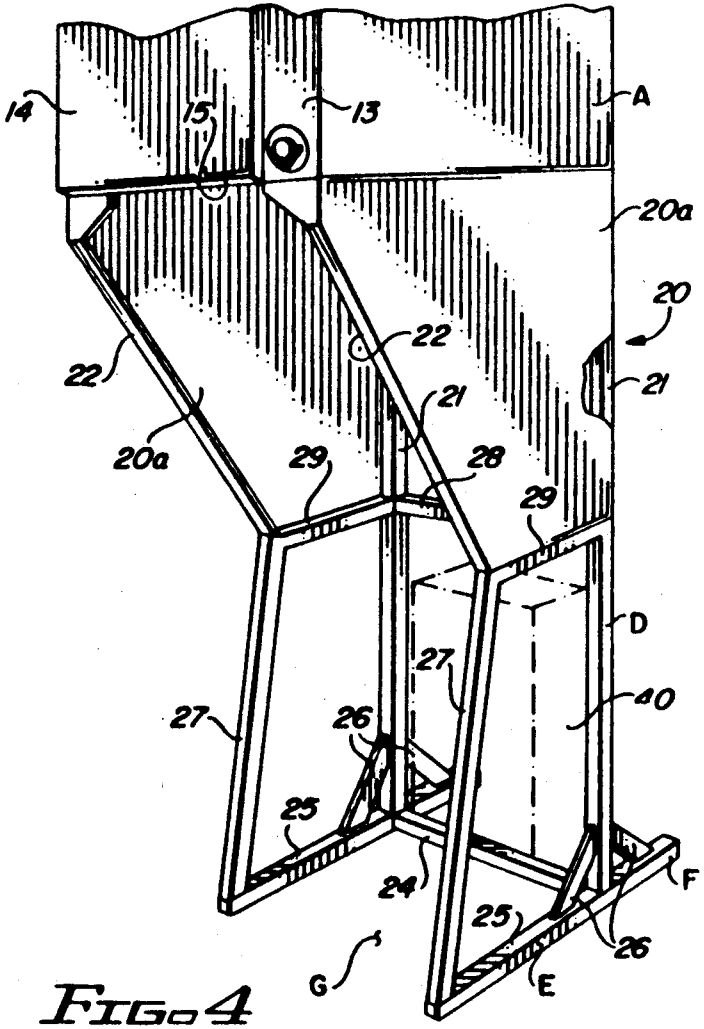
FIG. 4 is an enlarged perspective view further illustrating the hood support and base.

Referring more particularly to FIGS. 3 and 5, a cooking apparatus in the form of a deep fat pressure fryer is illustrated at 30 and included a cooking vessel 31 and a pressure cover 32. The movable cooking apparatus is illustrated as being carried upon casters 33 to render same readily portable within a location such as a convenience store.

Figure 2:
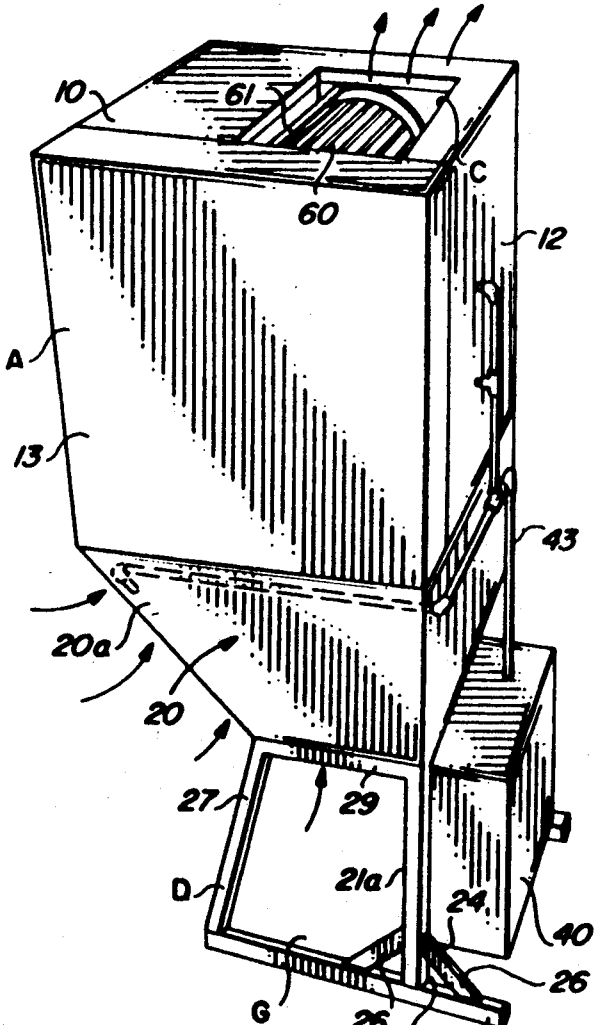
FIG. 2 is a perspective view looking from above the rear right hand corner of the apparatus shown in FIG. 1.

Referring more particularly to FIGS. 1, 2, and 3, fire extinguishing apparatus is carried within a rectangular box 40 positioned rearwardly of the bridging member 24 upon the rearward extension F of the base E. The extinguishing apparatus includes a fire extinguisher 41 (see FIG. 3) and a pipe which extends upwardly as at 43 to supply fire extinguishing material such as foam to the nozzle 44 which extends between the grease filter 17 and the filter assembly B. A nozzle 45 carried within the hood A above the filter assembly B, and a nozzle 46 carried above the cooker are also supplied with foam. A fusible link is illustrated at 47 for actuating the fire extinguishing mechanism responsive to excessive temperatures as would be caused by a grease fire.

The circulation of air within the hood A is produced as a result of the action of an impeller fan 60 which draws air containing grease-laden vapors or other contaminated air from the cooking apparatus upwardly through the open lower portion 15 of the hood A. The contaminated air is contaminated within the lower extension of the hood A prior to it passing through the opening 15 into a rectangular upper portion of the hood A passing through the grease filter 17 thence the pre-filter 16 and precipitator of the filter assembly B. The centrifugal fan 60 has a baffle 61 leading to the opening C in the top of the hood A.

Figure 6:
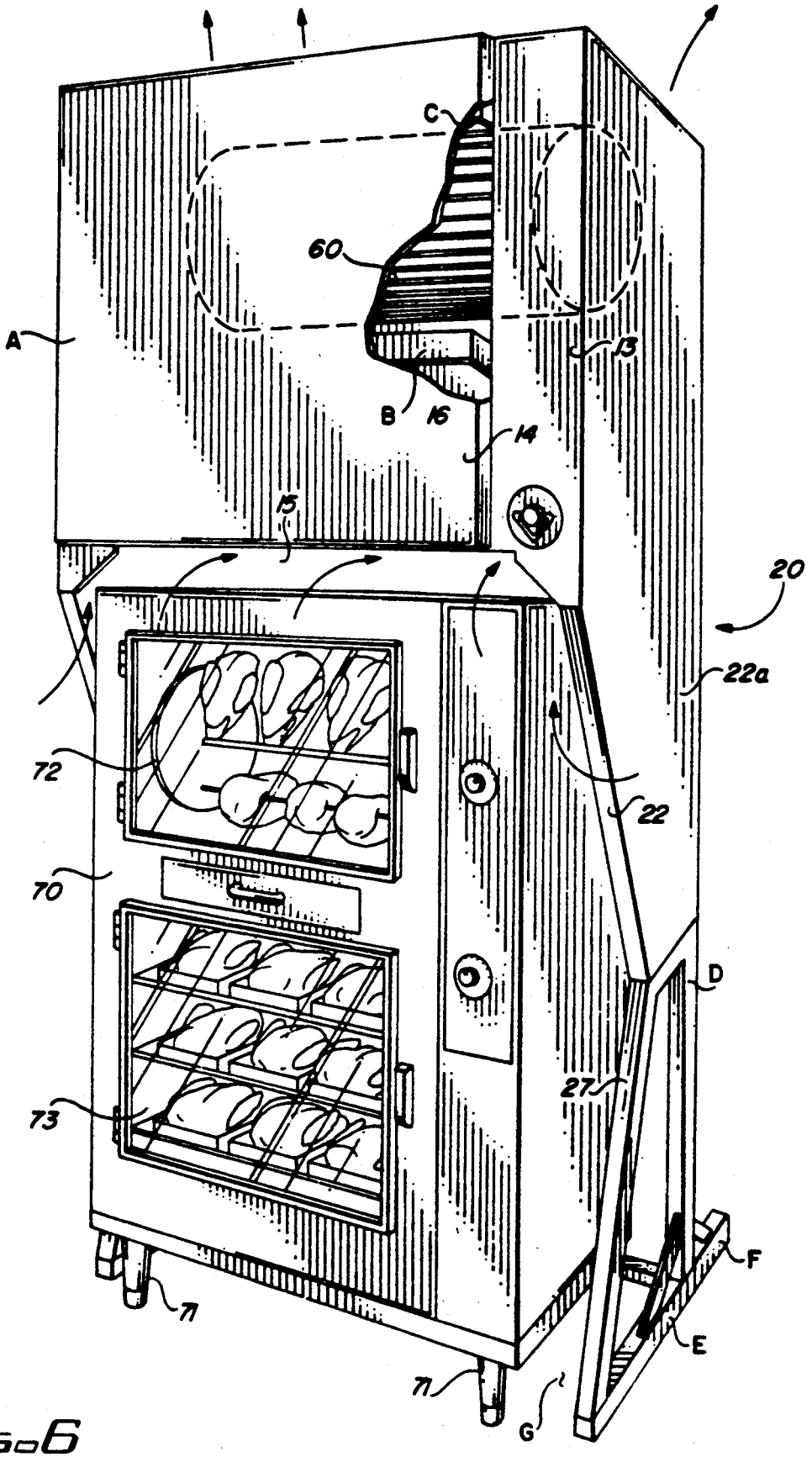
FIG. 6 is a perspective view illustrating a second embodiment of the invention.

FIG. 6 illustrates the second embodiment of the invention in that the spacing of the side frame members 27 forming the support structure D has been increase to straddle a larger cooking apparatus such as a barbecue machine 70. The barbecue machine 70 is movable and is carried upon legs 71. The barbecue machine 70 is contained within a receiving area G defined by the frame members 22 and 27. The barbecue machine 70 is illustrated as having a rotisserie 72 in an upper compartment and a lower compartment 73 for warming the food.

Contaminated air passes upwardly in the direction of across and through the lower opening 15 in the hood A and through the filter assembly B which includes the electrostatic filter responsive to the action of the fan 60. The air which has been filtered passes upwardly through opening C into the building.

It is thus seen that a free-standing exhaust hood has been provided. The hood A is carried upon a support structure D having an opening at one end provided by side frame members 22 and an open base E which defines a receiving area G for a cooking apparatus. The hood A is stably supported for movement within a store location and, due to the base E and support structure D, will not tip over either toward the front or rear. This arrangement provides greater versatility in locations such as convenience stores where due to changing space requirements the cooking apparatus may be moved about from time to time.

Figure 7:
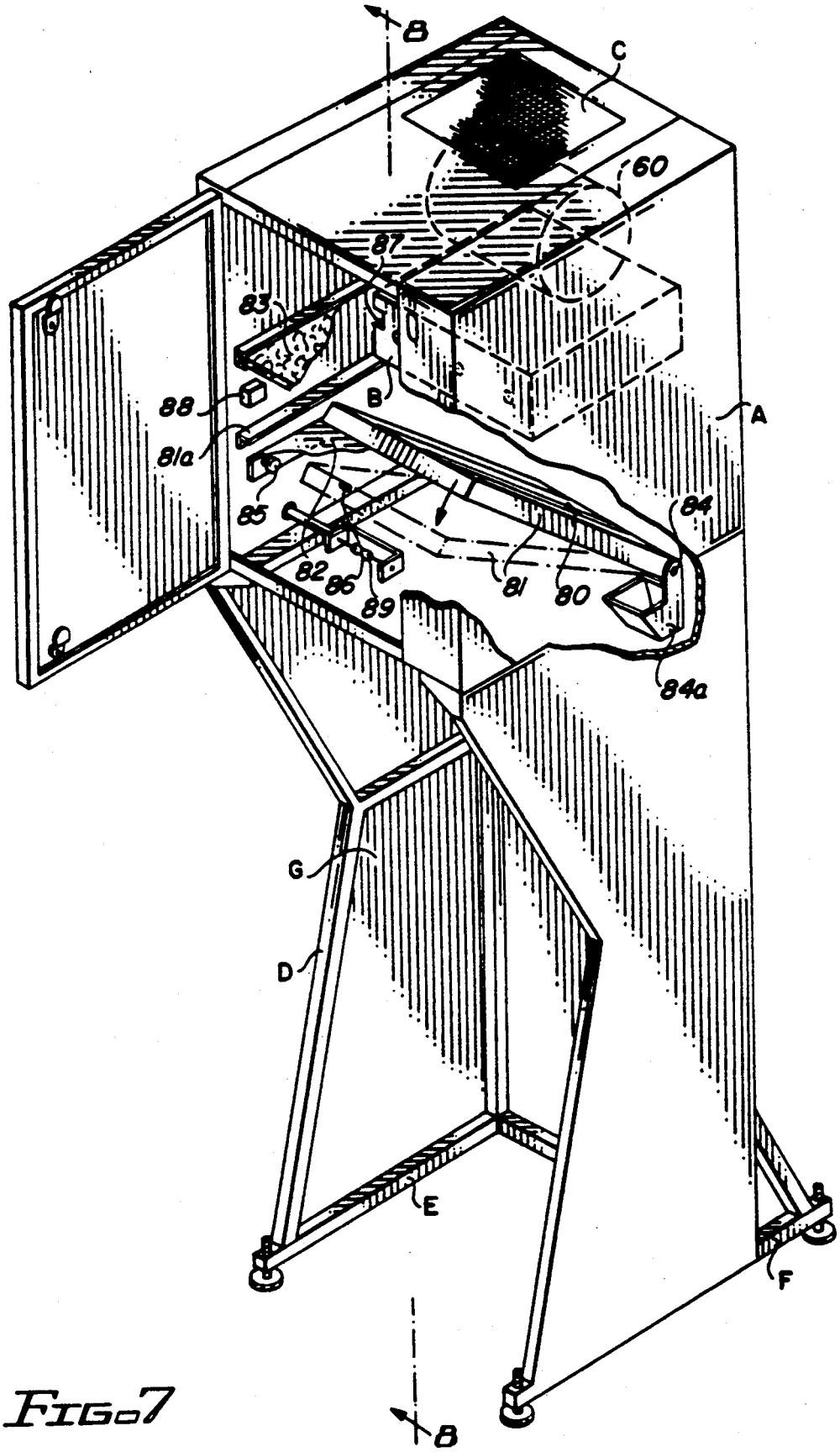
FIG. 7 is a perspective view illustrating a third embodiment of the invention.
Figure 8:
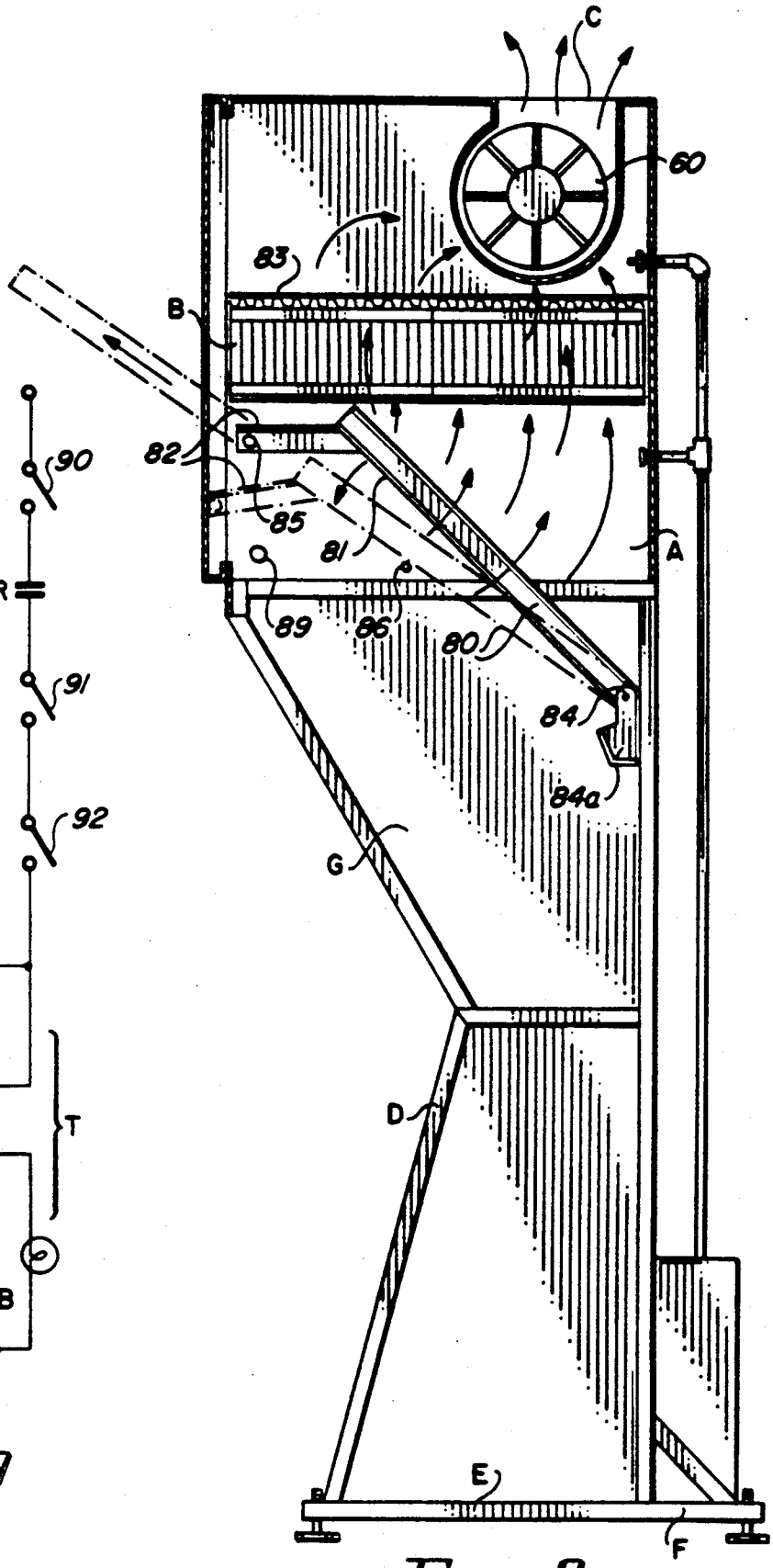
FIG. 8 is a sectional elevation taken on the line 8—8 in FIG. 7.

In the third embodiment of the exhaust hood A of the invention illustrated in FIGS. 7 and 8, the grease filter 80, such as a flame guard 80 manufactured by Flame Guard, Inc. of 6825 E. Washington, Blvd., Los Angeles, Calif., forms a bottom of the exhaust hood A permitting passage of vapors from the cooking apparatus therethrough. A support 81 within the hood A carries the grease filter/flame guard 81 at a predetermined critical angle extending downwardly from front to rear. The critical angle is recommended by the manufacturer for best operation in this case is illustrated as at 45 degrees. The filter assembly B is illustrated as an electrostatic precipitator and charcoal filter 83 that extend substantially horizontally in a horizontal frame 81*a*, spaced in vertical alignment above the grease filter/flame guard 81.

A fan 60 is carried in superposed vertical aligned relation above the filter assembly B. An air discharge opening C is in the housing above the fan 60. Thus, exhaust air is received in the grease filter/flame guard 80 and carried upward therethrough and thence vertically through the electrostatic precipitator 82 and charcoal filter 83 responsive to the fan 60.

In this third embodiment, an imperforate sheet member 82 extends forwardly of a forward upper edge of the grease filter/flame guard 80 and side members forming a receptacle for receiving exhaust air for passage into the filter. The support frame 81 carries the grease filter/flame guard 80 and is pivotal adjacent a rear edge thereof at 84, and a releasable fastener 85 adjacent a forward upper edge of the support frame 81 is provided fastening the grease filter 80 in raised operating position and in a lowered position against a stop 86 for servicing the grease filter 80. A keyway 87 is provided in the housing of the filter assembly B receiving a key 88. A cup 84*a* for collecting moisture is also pivotally carried at 84.

The fan positioned above the filter assembly B circulates exhaust in through the grease filter 80, the filter assembly B and discharges same from the housing. Thus, the grease filter 80, filter assembly B and the fan 60 are in vertically stacked aligned relation providing enhanced air flow with improved filtering action.

Figure 9:
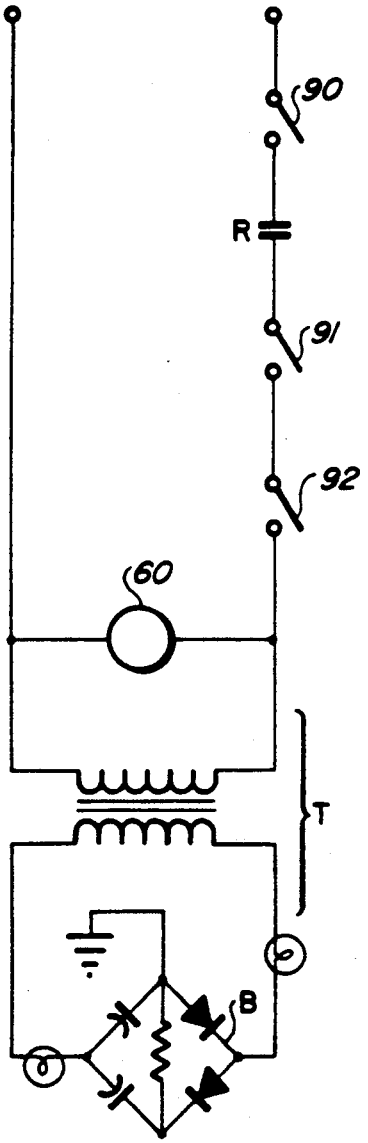
FIG. 9 is a schematic diagram illustrating operation of the components of the filter assembly including fan.

As shown in FIG. 9, power may be provided to the deep fat fryer which energizes the electrostatic precipitator of the filter assembly B provided the switches 90, 91 and 92 for cooking, flow and door, respectively, are closed. The fan blower 60 then forces the exhaust through the grease baffle 80 across the filter assembly B. While the precipitator of the filter assembly B is neutralizing the grease, a suitable signal light may flicker. If the door is opened, or flow is interrupted, or a fire starts and melts the fusible link 89 activating the extinguisher, the precipitator 82 of the filter assembly B and the fryer heater circuit will open.

Figure 10:
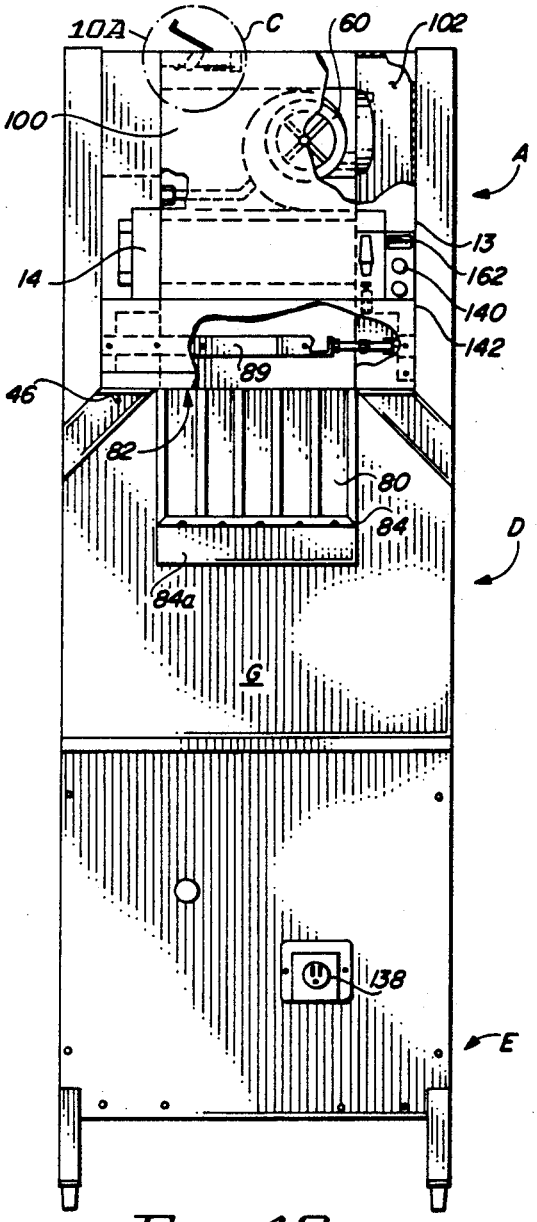
FIG. 10 is a front elevation, partially cut-away, of the fourth embodiment of the exhaust hood of the present invention having a grease filter and a disposable filter assembly positioned within a hood.
Figure 11:
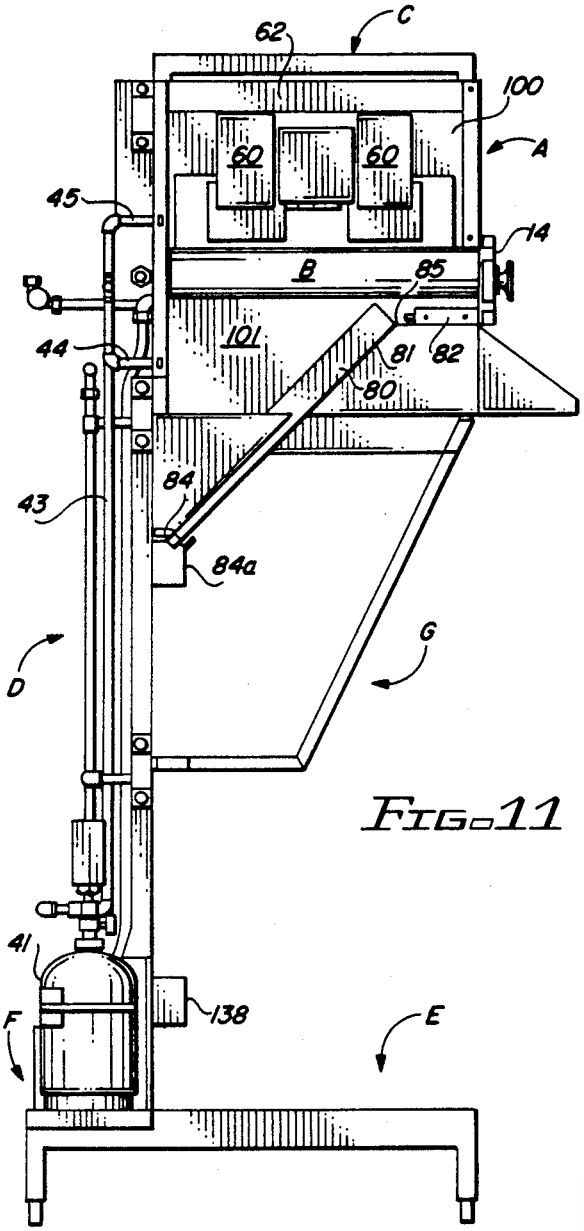
FIG. 11 is a left side cross-sectional view of FIG. 10 along lines 11—11 illustrating the pair of fans which draw the vapors from the cooking apparatus (not shown) through the grease filter and the disposable filter assembly to be cleaned and then exhausted via an elongated vent opening positioned along the left edge of the exhaust hood.

The fourth embodiment of the exhaust hood A of the invention is illustrated in FIGS. 10–15. More particularly, the fourth embodiment of the exhaust hood A is structurally similar to the third embodiment illustrated in FIGS. 7–9. Specifically, as best shown in FIGS. 10 and 11, the fourth embodiment comprises exhaust hood A, filter assembly B, opening C, support structure D, and base E having rearward extension F, which defines a receiving area G for receiving the cooking apparatus. A grease baffle/flame arrester 80 is carried by support 81 that is connected at a rear edge post 84 and is releasably secured into an upright position by means of releasable fastener 85. An imperforate sheet member 82 extends horizontally from the front edge of the grease baffle support 81. Upon release of fastener 85, the grease baffle support 81 may be slid out from the support 81. The grease baffle 80 can then be cleaned with a suitable detergent. Cup 84A is elongated and removably hooks onto the post 84 so as to collect grease and other moisture dripping from the grease baffle 80.

The rearward extension F supports the fire extinguisher 41 which is actuated when a fusible link 89, positioned under the hood A, is exposed to elevated temperatures. Upon actuation, the fire extinguishing material flows through pipes 43 to a nozzle 46 positioned immediately below the hood A and above the cooking apparatus (not shown), through a nozzle 44 positioned between the grease baffle 80 and the filter assembly B, and through a nozzle 45 positioned within the hood A.

A pair of fans 60 are positioned within the upper compartment 100 of the hood A. The fans 60 draw contaminated vapors from the cooking apparatus positioned within the receiving area G, through the grease baffle 80 and then through the filter assembly B to be exhausted via paired arcuate ducts 102 and opening C positioned along the left edge of the hood A. As best shown in the inset of FIG. 10, opening C comprises a closure door 104 which is biased by spring 106 to a closed position about opening C, but is retained in its open position by means of a fusible link 108. Upon being subjected to elevated temperatures, the fusible link 108 releases whereupon spring 106 closes door 104 about the opening C.

Figure 12:
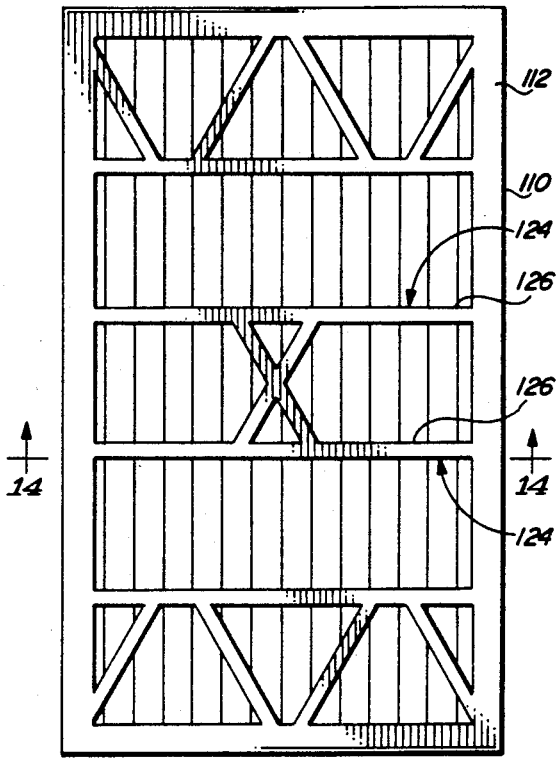
FIG. 12 is a plan view of the underside of the filter assembly.
Figure 10A:
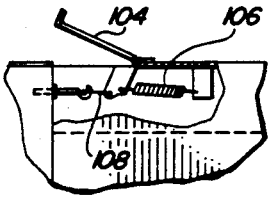
Figure 13:
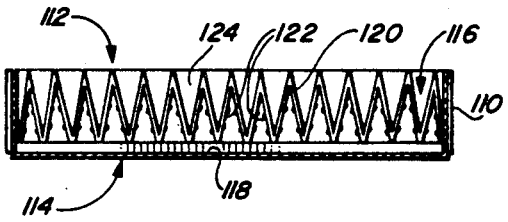
FIG. 13 is a cross-sectional view of FIG. 12 along lines 13—13 illustrating the accordion-shaped configuration of the fiberglass filter including a fiberglass mat mounted to mesh wire and illustrating the flat charcoal filter positioned at the upper surface of the fiberglass filter, both within the filter housing.

As shown in FIGS. 12 and 13, the filter assembly B of the present invention comprises a generally rectangular housing 110 having aperatured top and bottom sides 112 and 114 allowing free flow of air therethrough. A fiberglass filter 116 and a charcoal filter 118 are positioned within the housing 110. The charcoal filter 118 comprises a conventional charcoal mat designed to assist in the removal of odors from vapors flowing therethrough.

Preferably, fiberglass filter 116 comprises a fiberglass mat 120 which is adhered to a sheet of mesh wire 122. During assembly, the mesh wire 122, along with the fiberglass mat 120, are formed into an accordion-shape.

The rectangular housing 110 is preferably composed of cardboard and is manufactured by stamping sheets of cardboard stock into the desired pattern that forms a rectangular box when folded. However, this pattern also preferably comprises a plurality of triangular-shaped teeth 124 extending from horizontal segments 126. In this manner, when the charcoal filter 118 and the fiberglass filter 116 are slipped into the housing 110, the triangular-shaped teeth 124 may be folded downwardly between the pleats of the accordion-shaped fiberglass filter 116 thereby maintaining the shape of the filter 116.

The novel filter assembly B of the fourth embodiment of the invention is specifically designed so as to remove the finer particulate matter flowing through the grease baffle 80 and to assist in the deodorizing of the same prior to venting via opening C. Moreover, the construction of the filter assembly B with its charcoal and fiberglass filters 116 and 118 results in a highly economical filter assembly B which can be discarded after use. This disposable-type filter assembly B readily allows a contaminated filter assembly B to be removed via door 14 and replaced with a new filter assembly B.

Figure 14:
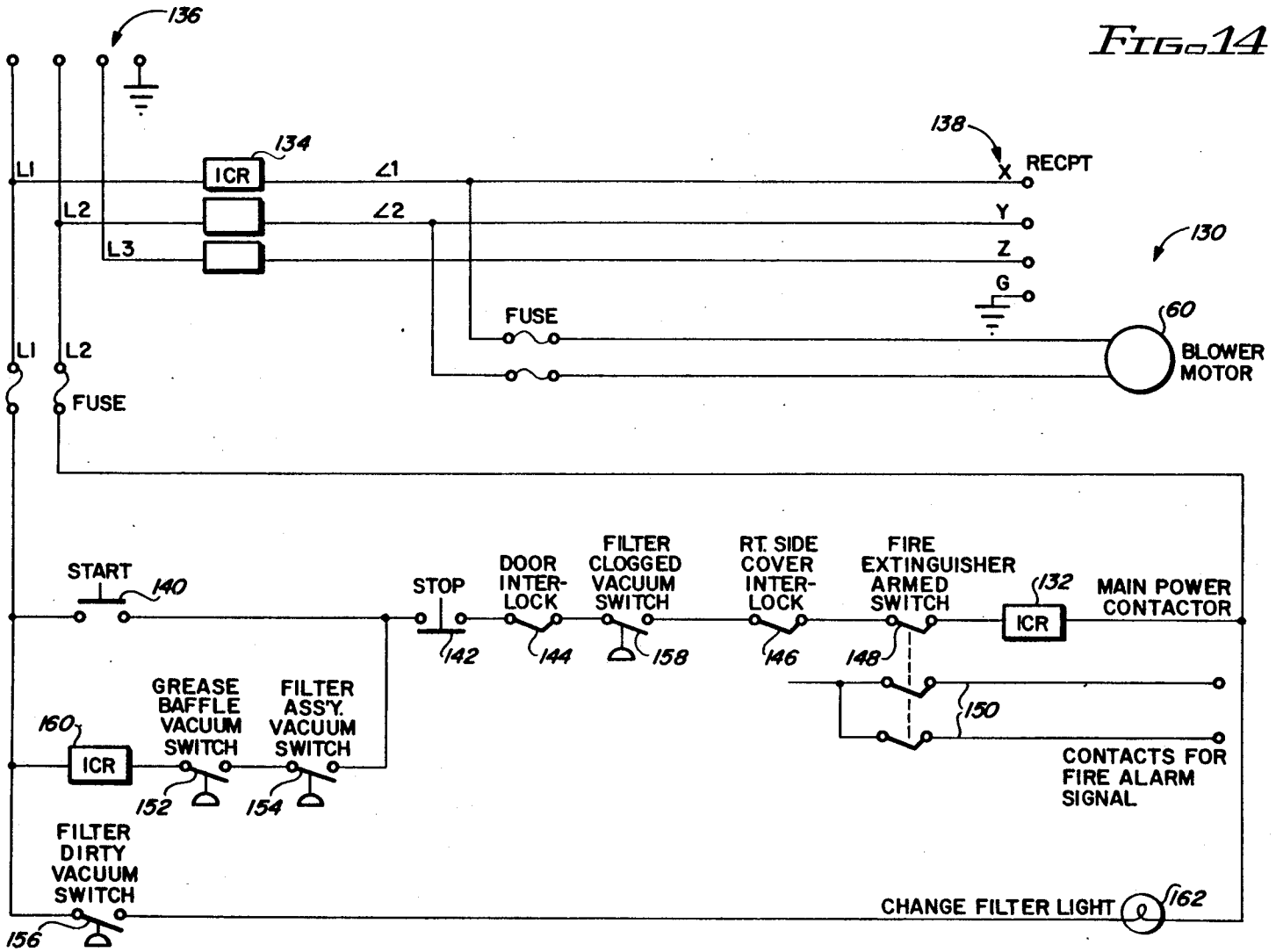
FIG. 14 is a schematic diagram of the sensor system which senses the existence of the grease and the filter assembly, and the condition of the filter assembly.

As shown in FIG. 14, the fourth embodiment of the exhaust hood A of the invention further comprises a novel control circuit, generally indicated by numeral 130, which senses the existence of the grease baffle 80 and the filter assembly B and the condition of the filter assembly B. Advance notice is provided to the operator when the filter assembly B requires changing and, if not changed, the control circuit 130 shuts down the exhaust hood A and the cooking apparatus when the filter assembly B becomes sufficiently clogged that it no longer satisfactorily filters the vapors from the cooking apparatus.

More particularly, the control circuit 130 comprises a main power contactor having a relay coil 132. The relay contacts 134 of the main power contactor are connected in-line between the building power 136 (three-phase) and a receptacle 138 positioned in the rear of the base E, allowing the cooking apparatus to be plugged into the receptacle 138 and powered thereby. The blower motor of fans 60 is connected to two legs L1 and L2 of the three phase power 136. In this manner, energization of the relay coil 132 of the main power contactor causes closure of relay contacts 134 thereby supplying power to the cooking apparatus via receptacle 138 and thereby supplying power to the blower motor of the fans 60.

Power is supplied to the relay coil 132 of the main power contactor by means of lines L1 and L2. Serially connected with the relay coil 132 of the main power contactor is a normally open, momentary start switch 140, a normally-closed, momentary stop switch 142, normally-opened, held-closed limit switches 144 and 146 functioning as door and right side cover interlock switches, and a normally-opened, held-closed fire extinguisher arm switch 148 operatively connected to normally-opened and normally-closed contacts for fire alarm signals 150.

Figure 15:
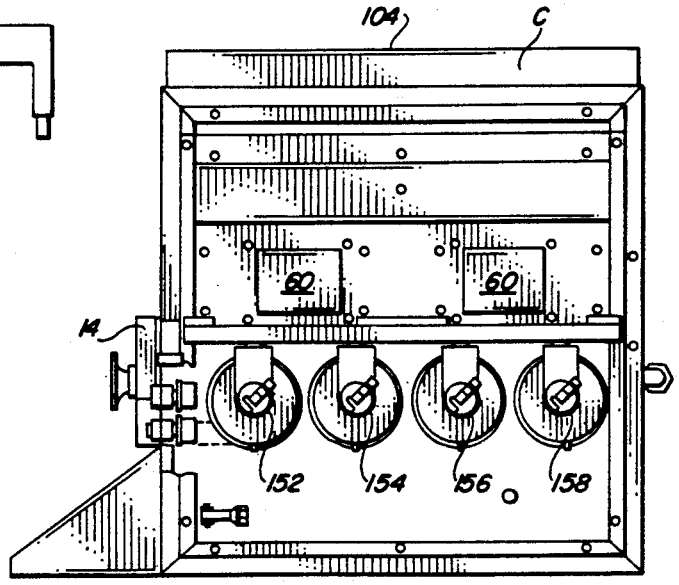
FIG. 15 is a right side view of FIG. 10 along lines 15—15 (with the arcuate fan duct removed for clarity) illustrating the vacuum switches positioned in a plenum in the exhaust hood above the filter assembly.

The control circuit 130 of the invention comprises four vacuum switches 152, 154, 156 and 158 which are positioned within the compartment 13 in the side of the hood A (see FIG. 15). Vacuum switch 152 is fluidly connected to the area between the grease baffle 80 and the filter assembly B and vacuum switches 154, 156, and 158 are fluidly connected to the area in the upper compartment 100 so as to sense the pressure within the intermediate area 101 between the filters 80 and B and the area in the upper compartment 100, respectively, of the hood A. The vacuum switches 152, 154, 156 and 158 are preset to actuate at a low vacuum, a medium vacuum, a high vacuum, and a highest vacuum, respectively. As described hereinafter in greater detail, the vacuum switches 152, 154, 156 and 158 therefore sense the existence of the grease baffle 80, the existence of the filter assembly B, the dirty (contaminated) condition of the filter assembly B, and the clogged condition of the filter assembly B, respectively.

Returning now to FIG. 14, the grease baffle switch 152 and the filter assembly switch 154 are serially connected with another relay contact 160 of the main power contactor. The serially connected normally-open grease baffle switch 152, normally-open filter assembly switch 154 and normally-open relay contact 160 are then connected in parallel with the start switch 140.

The normally-open filter dirty switch 156 is serially connected with a change filter light 162 which are in turn connected across power lines L1 and L2.

Finally, the normally-closed filter clogged switch 158 is serially connected with the limit switches 144 and 146.

When the start switch 140 is depressed to close its contacts and held, power from power lines L1 and L2 is supplied to the relay coil 132 of the main power contactor since switches 142, 144, 158, 146, and 148 are closed. The relay coil 132 is thus energized causing closure of its contacts 134 and 160.

Upon closure of relay contacts 134 (and 160), the blower motor of fans 60 are energized causing air to be drawn through the grease baffle 80 into the intermediate filter area 101 and thence through the filter assembly B into the upper compartment 100 to be exhausted via opening C, so as to create a vacuum in the intermediate filter area 101 and in the upper compartment 100. However, if the grease baffle 80 is not installed, no vacuum is created in the intermediate filter area 101 and the grease baffle switch 152 is not actuated (closed). Likewise, if filter assembly B is not installed, minimal vacuum (or no vacuum, if grease baffle is not installed) is created in the upper compartment 100 and filter assembly switch 154 is not actuated (closed). Power to the relay coil 132 is thus interrupted as soon as the start switch 140 is released.

If the grease baffle 80 and the filter assembly B are both installed, a low level of vacuum will be created in the intermediate filter area 101 and a medium level of vacuum will be created in the upper compartment, causing actuation (closure) of the grease baffle switch 152 and the filter assembly switch 154, respectively. The relay coil 132 is therefore latched and the held start switch 140 can then be released.

During use, the vacuum in the upper compartment 100 will gradually increase as the filter assembly B becomes contaminated. At a presettable high level of vacuum, the filter dirty switch 156 is actuated, closing its contacts to energize the change filter light 162. The operator is therefore notified that the filter assembly B requires changing.

Continued use gradually increases the vacuum in the upper compartment 100 as the dirty filter assembly B becomes clogged. At another presettable highest vacuum level, the filter clogged switch 158 is actuated and its contacts are opened, thereby interrupting power to the relay coil 132. When the relay coil 132 is deenergized, the contacts 134 (and 160) of the main power contacts are opened, thereby interrupting power to the cooking apparatus plugged into receptacle 138. Any attempted re-start will result in a shut down, until the clogged filter assembly B is replaced.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An exhaust hood assembly for positioning above a cooking apparatus, comprising in combination:

an exhaust hood defining an opened-ended compartment having an exhaust opening;

fan means positioned within said compartment for drawing air into said opened end of said compartment and exhaust said air from said compartment via said exhaust opening;

a filter assembly positioned across said opened end of said compartment for filtering vapors from said cooking apparatus; and control means for sensing vacuum created within said compartment upon operation of said fan means and for indicating proper operation of said filter assembly, said control means comprising a filter assembly vacuum switch positioned in fluid communication within said compartment which is presettable at a certain level of vacuum existing within said compartment such that said filter assembly vacuum switch is actuated when appreciable vacuum exists within aid compartment indicative of said filter assembly being properly installed, and said control means further comprising means for interrupting operation of said fan means if said filter assembly vacuum switch is not actuated.

2. The exhaust hood assembly as set forth in claim 1, wherein said control means further comprises a filter dirty vacuum switch positioned in fluid communication within said compartment which is presettable at a certain level of vacuum existing within said compartment such that said filter dirty vacuum switch is actuated when increased vacuum exists within said compartment caused by decreased air flow through said filter assembly indicative of a dirty said filter assembly that requires changing, and said control means further comprising means for actuating an indicator means when said filter dirty vacuum switch is actuated for indicating a dirty said filter assembly.

3. The exhaust hood assembly as set forth in claim 1, wherein said control means further comprises a filter clogged vacuum switch positioned in fluid communication within said compartment which is presettable at a certain level of vacuum existing within said compartment such that said filter clogged vacuum switch is actuated when increased vacuum exists within said compartment caused by decreased air flow through said filter assembly indicative of a clogged said filter assembly that requires changing, and said control means further comprising means for interrupting operation of said cooking apparatus when said filter clogged vacuum switch is actuated.

4. The exhaust hood assembly as set forth in claim 1, wherein said filter assembly comprises a fiberglass filter positioned within a housing having apertured top and bottom sides, said fiberglass filter including a fiberglass mat formed in an accordion-shaped configuration which increases the surface area of said fiberglass mat exposed to air flow through said top and bottom sides of said housing.

5. The exhaust hood as assembly as set forth in claim 4, wherein said filter assembly further comprises a charcoal filter positioned within said housing.

6. The exhaust hood assembly as set forth in claim 5, wherein said filter assembly is oriented across said opened end of said compartment with said fiberglass filter being positioned upstream and said charcoal filter being positioned downstream of said air drawn into said compartment.

7. The exhaust hood assembly as set forth in claim 6, wherein said fiberglass filter further comprises a sheet of mesh wire to which said fiberglass mat is positioned prior to being formed into said accordion-shaped configuration such that both said fiberglass mat and said mesh wire are simultaneously formed in an accordion-shaped configuration.

8. The exhaust hood assembly as set forth in claim 7, wherein said fiberglass mat is adhered to said mesh wire.

9. The exhaust hood assembly as set forth in claim 1, further including a grease baffle positioned upstream of said filter assembly defining an intermediate filter area between said grease baffle and said filter assembly and further including grease baffle control means for sensing vacuum created within said intermediate filter area operation of said fan means.

10. The exhaust hood assembly as set forth in claim 9, wherein said grease baffle control means comprises a vacuum switch which is presettable at a certain level of vacuum existing within said intermediate filter area.

11. The exhaust hood assembly as set forth in claim 10, wherein said vacuum switch is actuated when appreciable vacuum exists within said intermediate filter area indicative of said filter assembly being properly installed.

* * * * *